US006783397B2

(12) United States Patent
Yang Lee

(10) Patent No.: US 6,783,397 B2
(45) Date of Patent: Aug. 31, 2004

(54) CONNECTOR

(76) Inventor: Su-Lan Yang Lee, 8th Floor, No. 506-2, Yuan-Shan Road, Chung Ho City, Taipei Hsien (TW)

( * ) Notice: Subject to any disclaimer, the term of this patent is extended or adjusted under 35 U.S.C. 154(b) by 0 days.

(21) Appl. No.: 10/337,335

(22) Filed: Jan. 7, 2003

(65) Prior Publication Data

US 2003/0139095 A1 Jul. 24, 2003

(30) Foreign Application Priority Data

Jan. 22, 2002 (TW) ..... 91200564 U

(51) Int. Cl.[7] ..... H01H 13/648
(52) U.S. Cl. ..... 439/607; 439/610
(58) Field of Search ..... 439/607, 610, 439/96, 98, 108

(56) References Cited

U.S. PATENT DOCUMENTS 5,725,395 A * 3/1998 Lee ..... 439/610
5,941,733 A * 8/1999 Lai ..... 439/610
6,142,827 A * 11/2000 Lin ..... 439/610
6,165,016 A * 12/2000 Lai ..... 439/610
6,390,852 B1 * 5/2002 Wang ..... 439/610
6,508,678 B1 * 1/2003 Yang ..... 439/677
6,652,317 B2 * 11/2003 Shao ..... 439/607

* cited by examiner

*Primary Examiner*—Tho D. Ta
(74) *Attorney, Agent, or Firm*—Rosenberg, Klein & Lee

(57) ABSTRACT

A connector includes a base seat, a terminal main body is snugly fitted in the base seat and a cover body correspondingly latched with rear section of the base seat. A front section of the base seat being formed with a frame section. A rear section of the base seat being formed with a wire seat section. Two side walls of the frame section and the wire seat section integrally continuously extending without any fissure. The terminal main body formed with multiple terminal cavities in which multiple terminals are inlaid. The cover body and the wire seat section of the rear section of the base seat firmly clamp and enclose a lead therein, after assembled, the base seat and the cover body being enclosed by an insulating layer to form a complete connector.

1 Claim, 5 Drawing Sheets

CONNECTOR

BACKGROUND OF THE INVENTION

1. Field of the Invention

The present invention is related to a connector in which the base seat has a front frame section and a rear wire seat section. Two side walls of the frame section and the wire seat section integrally continuously extend so as to prevent stress from concentrating on the adjoining section between the frame section and the wire seat section and avoid bending and deformation. The terminal main body of the connector is firmly clamped and located by the base seat and a cover body.

2. Description of the Prior Art

FIGS. 5 and 6 show a computer-used connector. The plug of the connector has a terminal main body B and a pair of shielding casings for accommodating the terminal main body B. The shielding casings include a base seat S1 and a cover body S2. The front section of the base seat S1 is formed with a T-shaped frame section S11. The rear section of the base seat S1 is formed with a wire connecting section S12. When assembled, the front end of the terminal main body B is fitted in the frame section S11 of the base seat. A first interference section 343 of the front end of the terminal main body B abuts against a projecting section 362 in the frame section S11. In assembly and application, the conventional connector has some shortcomings as follows:

1. As shown in FIGS. 5 and 6, a fissure S13 is formed on the side wall of a section of the base seat S1 adjoining the front frame section S11 with the rear wire connecting section S12. When transferred or assembled, in the case that the base seat S11 suffers external force F, the stress is likely to concentrate at the fissure S13. As a result, the base seat S1 tends to bend and deform at the fissure S13 to form a wasted product.

2. Only the front end of the terminal main body B abuts against the base seat S1. The rear side of the terminal main body B is without any support of other element. Therefore, the terminal main body B is likely to slip or retreat.

SUMMARY OF THE INVENTION

It is therefore a primary object of the present invention to provide a connector including: a base seat, a front section of the base seat being formed with a frame section, a rear section of the base seat being formed with a wire seat section, two side walls of the frame section and the wire seat section integrally continuously extending so as to prevent stress from concentrating on the adjoining section between the frame section and the wire seat section and avoid bending and deformation; a terminal main body formed with multiple terminal cavities in which multiple terminals are inlaid, at least one projecting section being formed on outer side of the terminal main body, whereby when the front section of the terminal main body is correspondingly fitted into the frame section of the base seat, the projecting section abuts against an outer edge of a stopper shoulder of the base seat; and a cover body correspondingly latched with rear section of the base seat, whereby the cover body and the wire seat section of the base seat firmly clamp and enclose a lead therein. At least one support plate projects from the cover body for abutting against rear side of a stopper shoulder of the terminal main body so as to firmly clamp and locate the terminal main body.

The present invention can be best understood through the following description and accompanying drawings wherein:

DETAILED DESCRIPTION OF THE PREFERRED EMBODIMENT

Figure 1:
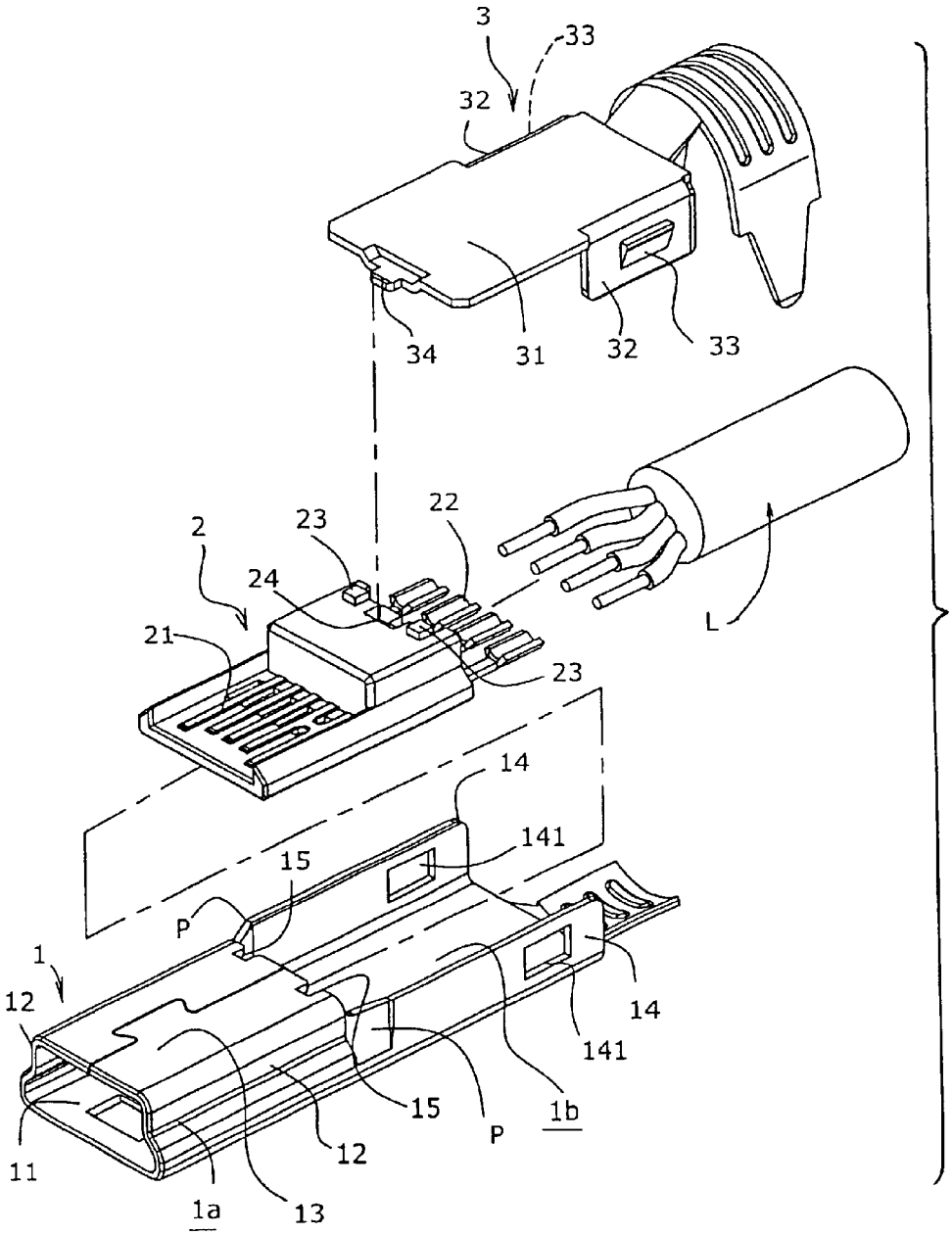
FIG. 1 is a perspective exploded view of the present invention.

Please refer to FIGS. 1 to 4. The connector of the present invention includes a base seat 1; a terminal main body 2 in which multiple terminals 22 are inlaid, the terminal main body 2 being snugly fitted in the base seat 1; and a cover body 3 correspondingly latched with rear section of the base seat 1 to enclose a lead L therein. The cover body 3 and the base seat 1 tightly clamp the terminal main body 2. After assembled, the base seat 1 and the cover body 3 are enclosed by an insulating layer 4 to form a complete connector.

Referring to FIGS. 1 to 4, the base seat 1 is made of a metal board and has a base board 11. Two side walls 12 respectively upward windingly extend from two sides of front section of the base board 11. The top ends of the side walls 12 oppositely radially extend to latch with each other to form a top board section 13 and define a T-shaped frame section 1*a*. Two side walls 14 respectively upward integrally extend from two sides of rear section of the base board 11. The side walls 14 and the base board 11 define a wire seat section 1*b* on which the lead L is rested. The side walls 14 of the wire seat section 1*b* integrally continuously extend from the two side walls 12 of the frame section 1*a*. Accordingly, when the base seat 1 suffers an external force, the stress is prevented from concentrating on the adjoining section P between the frame section 1*a* and the wire seat section 1*b* so as to avoid bending and deformation.

Figure 2:
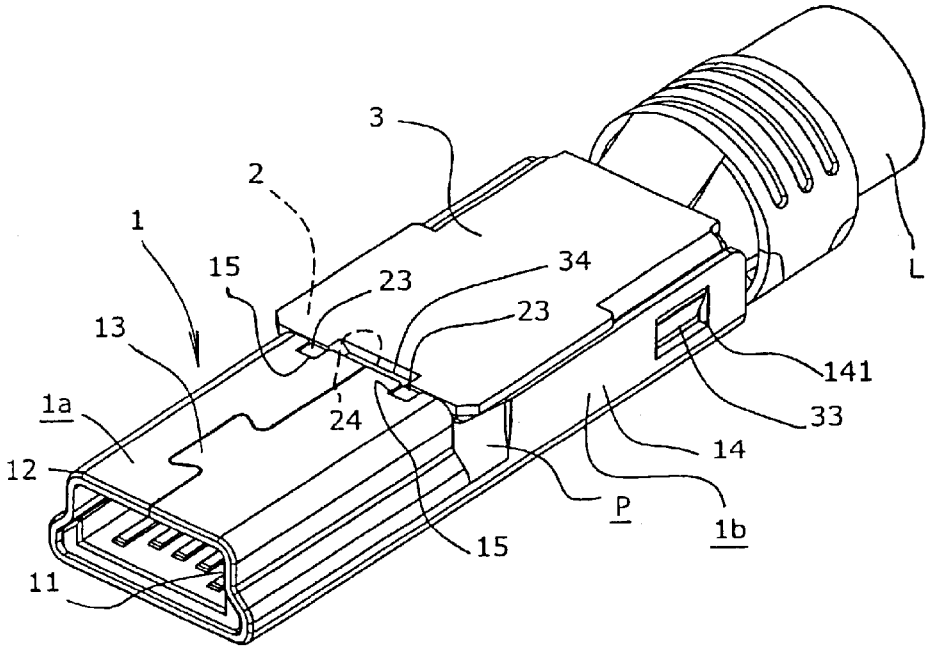
FIG. 2 is a perspective assembled view of the present invention.
Figure 3:
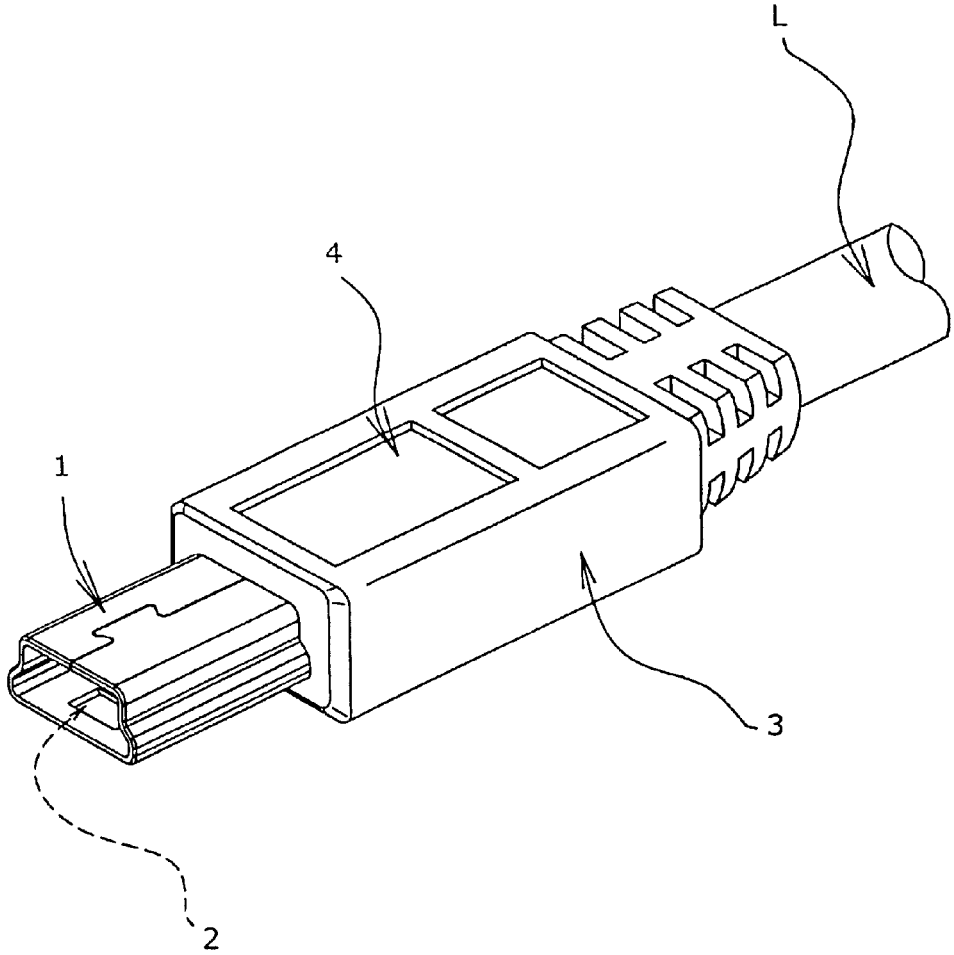
FIG. 3 is a perspective view of the present invention, showing that the base seat and the cover body are enclosed by an insulating layer.

Referring to FIGS. 1 and 2, the terminal main body 2 is formed with multiple terminal cavities 21 in which multiple terminals 22 are inlaid. At least one projecting section 23 is formed on outer side of the terminal main body 2. When the front section of the terminal main body 2 is correspondingly fitted into the frame section 1*a* of the front section of the base seat 1, the projecting section 23 abuts against an outer edge 15 of a stopper shoulder of the base seat 1.

The cover body 3 is made of metal board and has a board section 31. Two side walls 32 respectively downward integrally extend from two sides of the board section 31. Each side wall 32 has at least one outward projecting latch hook 33 which is correspondingly hooked in latch hole 141 of the side wall 14 of the wire seat section 1*b*. In addition, at least one support plate 34 projects from front edge of the cover body 3. When the cover body 3 is correspondingly latched with the base seat 1, the support plate 34 abuts against rear side of a stopper shoulder 24 of the terminal main body 2. Accordingly, the terminal main body 2 is firmly clamped and located by the support plate 34 and the outer edge 15 of the stopper shoulder of the base seat 1.

Figure 4:
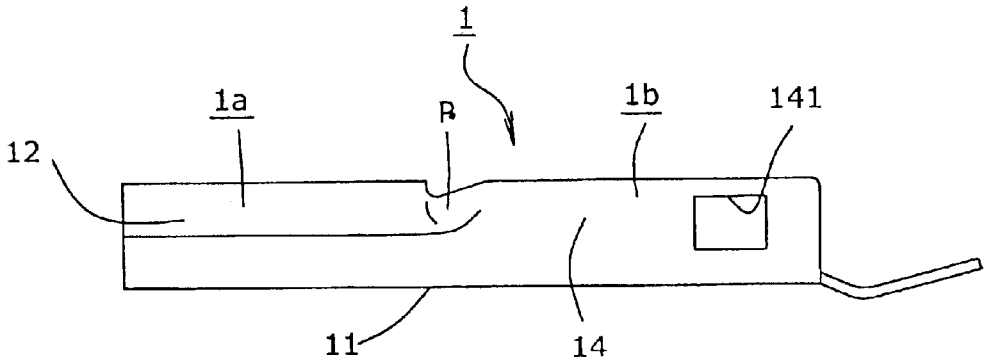
FIG. 4 is a side view of the base seat of the present invention.
Figure 5:
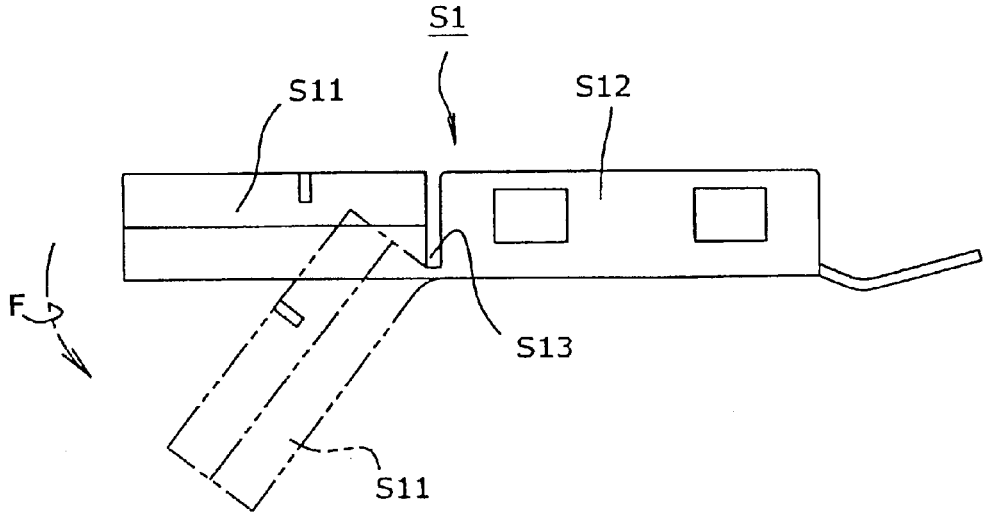
Fig. 5 PRIOR ART
FIG. 5 is a side view of the base seat of a conventional connector.
Figure 6:
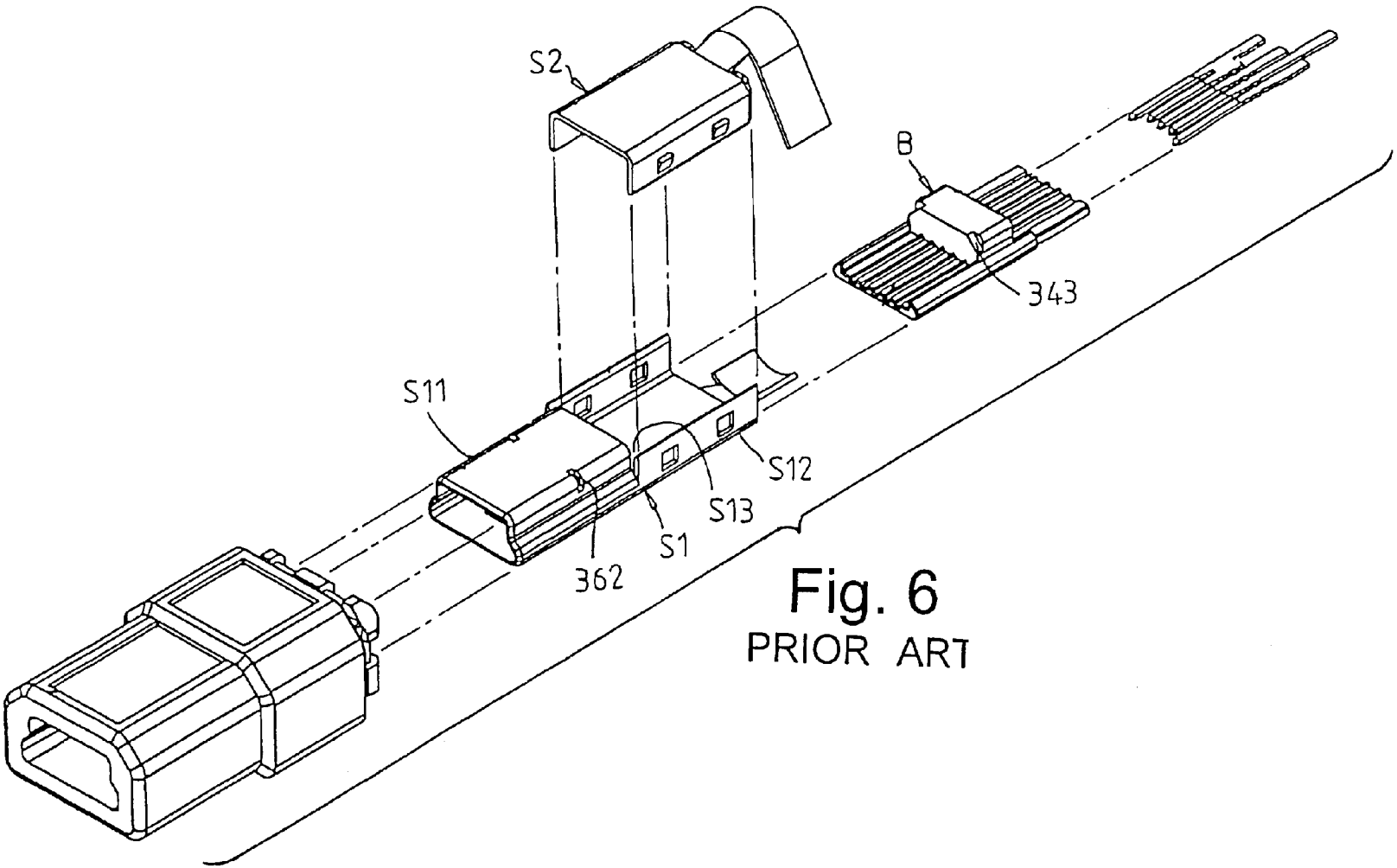
Fig. 6 PRIOR ART
FIG. 6 is a perspective exploded view of the conventional connector.

Referring to FIG. 4, the side walls 12, 14 of the frame section 1*a* and wire seat section 1*b* of the base seat 1 are integrally formed at the adjoining section P between the frame section 1*a* and the wire seat section 1*b* without any fissure. Therefore, when suffering external collision force such as in transferring or assembling procedure, the stress is prevented from concentrating on the adjoining section P between the frame section 1*a* and the wire seat section 1*b* so as to avoid bending and deformation of the base seat 1 at the adjoining section P. Moreover, the terminal main body 2 is clamped by the stopper shoulder 15 of the base seat 1 and the support plate 34 of the cover body 3 from front side and rear side so that the terminal main body 2 is firmly located without swinging.

The above embodiment is only used to illustrate the present invention, not intended to limit the scope thereof. Many modifications of the above embodiment can be made without departing from the spirit of the present invention.

What is claimed is:

1. A connector comprising:

(a) a base seat, a front section of the base seat being formed with a frame section, a rear section of the base seat being formed with a wire seat section, the frame section having two side walls with a non-planar contour and the wire seat section having two sidewalls with a planar contour, each of the two side walls of the wire seat section being integrally formed with a respective one of the two side walls of the frame section in a continuously extending manner without any fissure being formed therebetween, each said sidewall of said wire seat section being joined to a corresponding sidewall of said frame section by an angularly directed adjoining section, each said adjoining section providing a transition between said planar contour of a respective wire seat section sidewall and said non-planar contour of a respective frame section sidewall;

(b) a terminal main body formed with multiple terminal cavities in which multiple terminals are inlaid, the terminal main body being snugly fitted in the base scat; and (c) a cover body correspondingly latched with the rear section of the base seat, whereby the cover body and the wire seat section of the rear section of the base seat firmly clamp and enclose a lead therein, and wherein after being assembled the base seat and the cover body are enclosed by an insulating layer to form a complete connector.

* * * * *